United States Patent [19]

Bressler

[11] 4,255,640

[45] Mar. 10, 1981

[54] DOOR MOUNTED OVEN CONTROLS

[75] Inventor: Peter W. Bressler, Philadelphia, Pa.

[73] Assignee: Litton Systems, Inc., Beverly Hills, Calif.

[21] Appl. No.: 86,497

[22] Filed: Oct. 19, 1979

[51] Int. Cl.[3] ..... H05B 6/66

[52] U.S. Cl. ..... 219/10.55 B; 126/190; 126/200; 219/10.55 D

[58] Field of Search ..... 219/10.55 R, 10.55 B, 219/10.55 C, 10.55 D; 68/12 R; 126/200, 190

[56] References Cited

U.S. PATENT DOCUMENTS

| | | | |
|---|---|---|---|
| 3,965,325 | 6/1976 | Hirai | 219/10.55 R |
| 3,997,752 | 12/1976 | Nakano | 219/10.55 R |
| 4,000,390 | 12/1976 | Graff | 219/10.55 D |
| 4,101,750 | 7/1978 | Doner | 219/10.55 D |
| 4,146,769 | 3/1979 | Jarvis | 219/10.55 D |

*Primary Examiner*—Arthur T. Grimley

*Attorney, Agent, or Firm*—Robert E. Lowe; Edward P. Heller

[57] ABSTRACT

A microwave oven having the control panel mounted on the door. The control panel includes a plurality of pushbutton switches for the user to push to control the speed, time, etc. for variable cooking in the microwave oven. The switches communicate to an electronic controller also mounted on the door. The controller converts user input into signals that control the various operating components of the oven, such as the magnetron. The controller is connected with these components via a flexible printed circuit cable which bridges the space between the door and the oven near or through the hirge area of the oven.

7 Claims, 4 Drawing Figures

Fig. 1
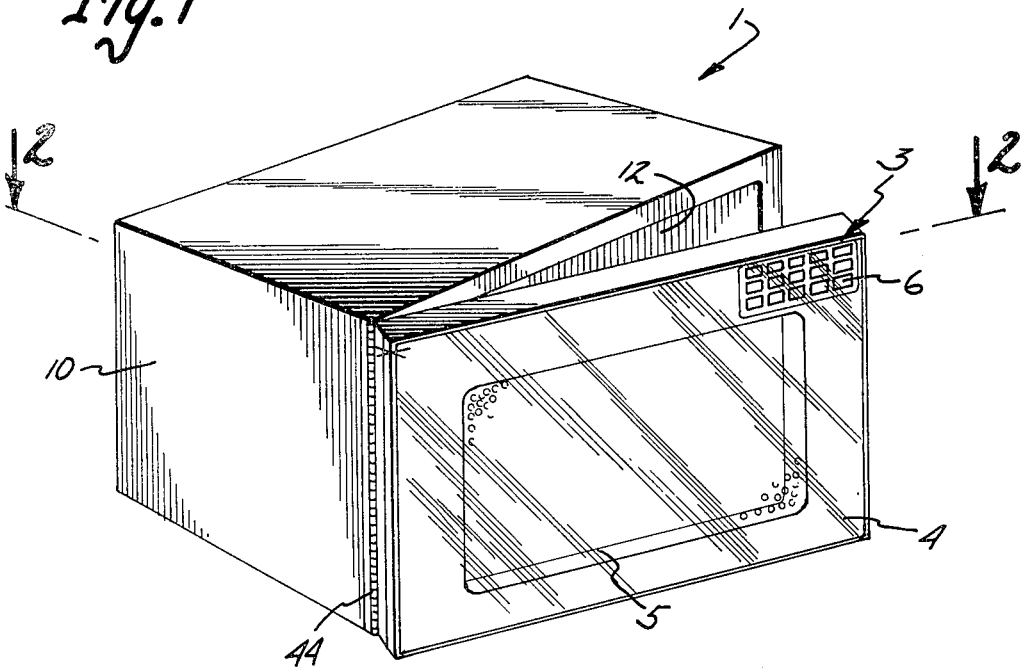
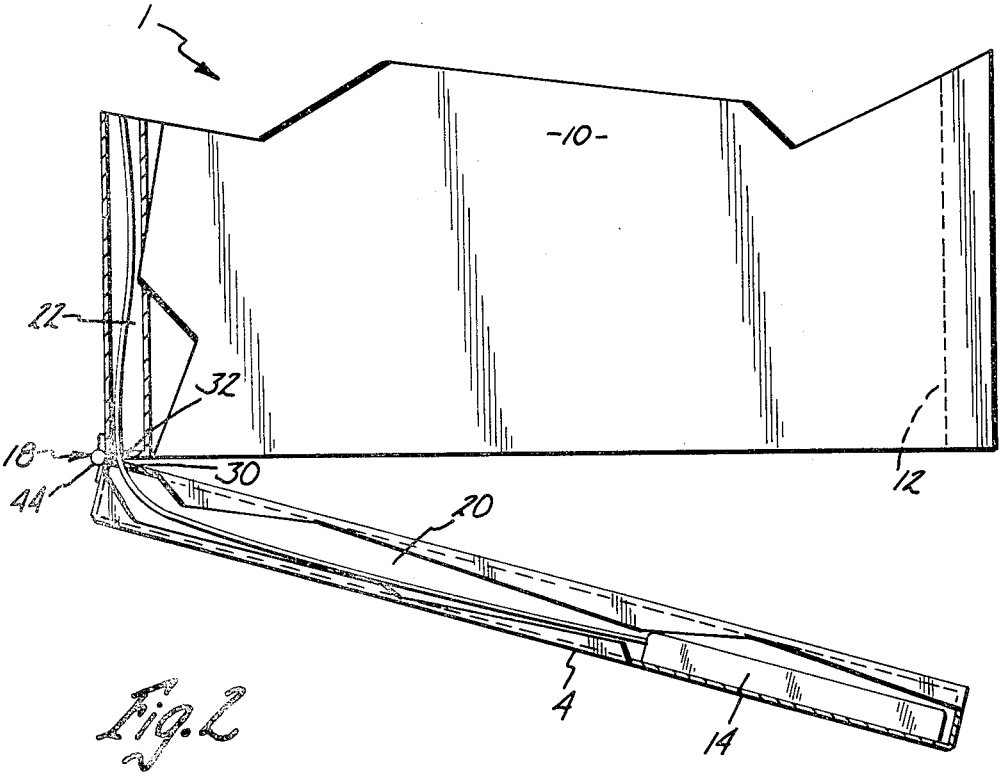
Fig. 2

DOOR MOUNTED OVEN CONTROLS

BACKGROUND OF THE INVENTION

1. Field of the Invention

The present invention relates generally to improvements in microwave ovens and more particularly to improvements in mounting the microwave oven control panel.

2. Brief Description of the Prior Art

Microwave ovens, indeed all ovens, have heretofore been constructed with a separate area mounted on the oven housing especially dedicated for the mounting thereon of the microwave oven controls. This separate area has been commonly known as a control panel. A good example of the state of the prior art can be seen by reference to U.S. Pat. to Ronald G. Buck, No. 4,162,381, assigned to the assignee of the present invention.

This location was dictated because the components to be controlled were located inside the main oven housing. The only other conceivable location of the control panel, the door, was not an obvious location primarily because of two factors: first, there was the difficulty of communicating signals from the controls mounted on the rotably mounted door to the components mounted in the fixed oven housing; and second, there was the difficulty in communicating these signals across the space between the door and the oven housing which, in a microwave oven, was subject to high electromagnetic interference (noise) from leakage from the cavity, magnetron and other high power electrical devices mounted with the oven housing.

SUMMARY OF THE INVENTION

The present invention overcomes the first difficulty by communicating signals between the door mounted control panel and the oven housing mounted components by means of a flexible cable: printed circuit, fiber optics or an equivalent; mounted such that it runs through apertures in the door and oven housing substantially about the axis of rotation of the axially mounted door.

The present invention overcomes the second difficulty by mounting in the door an electronic controller which receives highly sensitive low power signals from the control panel switches and converts them into relatively higher power signals to be communicated to the oven's operating components which, due to their higher power levels, are relatively insensitive to the electromagnetic noise present in and about the space between the door and the oven housing member.

These and other advantages and objects of the present invention will be more readily appreciated in the following detailed description when taken in view of the accompanying drawings, in which like reference numerals refer to like elements throughout the figures.

BRIEF DESCRIPTION OF THE DRAWING

FIG. 1 is a perspective view of the microwave oven door showing the oven's control panel mounted thereon and a substantially transparent window.

FIG. 2 is the viewing along line 2—2 with the door open showing an electronic controller mounted interior to the door, a flexible connector and the top of an axially mounted hinge arrangement.

DESCRIPTION OF THE PREFERRED EMBODIMENT

Figure 3:
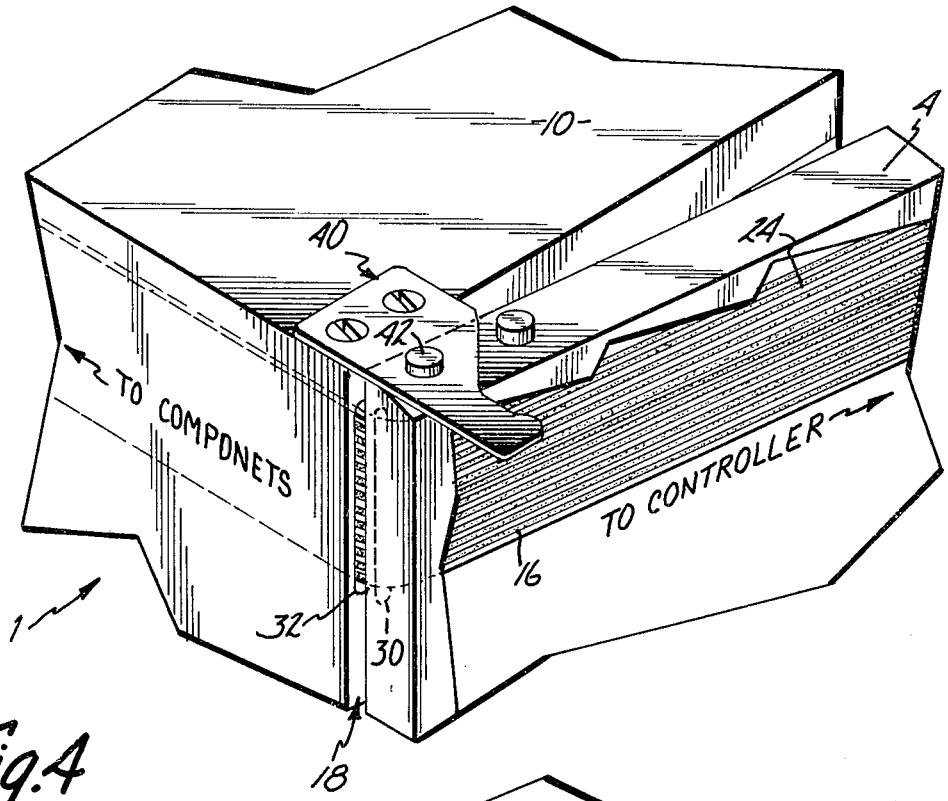
FIG. 3 is a cutaway perspective view of the upper left front portion of the oven with the door open showing a printed flexible circuit running from an aperture in the oven housing into a corresponding aperture in the oven door. The figure also shows one hinge of an alternative pivotally mounted hinge arrangement.

A microwave oven (shown generally as 1) is conventionally constructed with a housing member 10 and a door 4. Mounted interior to such a housing member 10 are the various operating components of the microwave oven 1 such as the cooking cavity, the magnetron (not shown), which emits microwaves, the power supply (not shown), and various sensors and other circuits and devices (also not shown). These components have been conventionally controlled, either manually or elecrically, by manually operable controls mounted on the housing member 1. Such an arrangement is shown in FIG. 1 of U.S. Pat. No. 4,162,381, to Buck. The housing area in which these controls have been heretofore mounted is known as a control panel. As can be seen by reference to Buck '381, this control panel requires an area on the housing member facing the user thus reducing the percentage of area on the front of the microwave oven usable as a cooking cavity. Should the control panel instead be mounted on the door, as in FIG. 1 of the present application, the frontal area consumed by the cooking cavity 12 could be enlarged to cover substantially the entire frontal area of the microwave oven 1; or similarly, the frontal area of the microwave oven 1 can be reduced. In addition to reducing wasted space, mounting the control panel on the oven door has the advantage of delivering a higher capacity oven per square inch of oven front, which is highly important to the consumer. He gets either a smaller sized oven with the same capacity as before or a larger capacity oven no larger in size.

Figure 4:
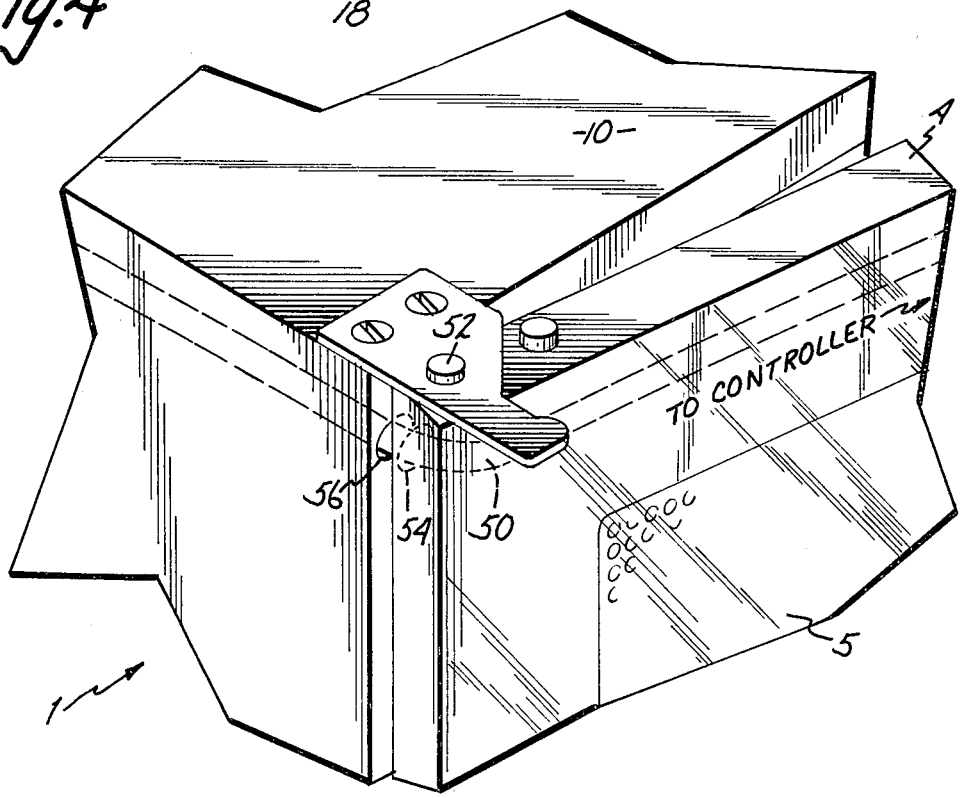
FIG. 4 is a perspective view of the upper front portion of the oven with the door open showing a fiber optics cable running from an aperture in the oven housing to a corresponding aperture in the oven door.

Additionally, by mounting the control panel 3 on the door 4 rather than on the housing member 10, heavy oven components, such as a power supply transformer conventionally mounted on the side of the housing member as in FIG. 4 of Buck '381, can now be mounted to the rear, thus increasing the amount of rearward weight relative to the front to assist in preventing forward tipping of the microwave oven 1 when the door is open.

In the preferred embodiment, the control panel 3 is mounted on the upper right hand portion of the microwave oven door 4. The control panel is composed of a plurality of pushbutton switches 6 of conventional design. Those switches 6 may also conveniently be of the capacitive touch type.

The location of the control panel 3 on the door 4 is not critical. The present location was chosen to allow the inclusion in the door 4 of a semitransparent window 5 which allows the user convenient visual access to the oven's cooking cavity 12 during oven operation.

The switches 6 are electrically connected to an electronic controller 14 mounted in the door 4 just interior to the control panel 3. This controller 14 receives input from the switches 6 and converts them into signals to be communicated to the oven's operating components. The location of the controller 14 near the switches 6 on the door 4 is necessary due to the presence of electromagnetic noise emitting from the cooking cavity 12 and the magnetron through the space between the door 3 and the oven housing member 10. The signals from the switches 6 to the controller 14 are of lower power and voltage and would thus tend to be more sensitive to this noise if they were to pass through the high noise region. However, the output from the controller 14 to the oven's components can be adjusted such that the noise level will cause no noticeable effect upon signal transmission.

The output signals from the controller 14 to the oven's components and the electric power and feedback signals to the controller 14 and switches 6 are transmitted, in the preferred embodiment, via a flexible printed circuit cable 16, such as that available from Sheldahl, Inc., Electrical Products Division, Northfield, MN. The cable 16 is connected at one end to the controller 14, as in FIG. 2. It then runs out an aperture 30 near the hinge area 18 of the door 4, across the space between the door 4 and housing member 10, as in FIGS. 2 and 3, into a second aperture 32 mounted in the housing member 10 near the hinge area 18, and from there to the oven's operating components. In the preferred embodiment, these apertures 30 and 32 are located at or slightly interior to the axis of rotation of the door 4. Thus, in a typical hinge arrangement 40 of FIG. 3, the pivot 42 is located just above the apertures 30 and 32. While if the hinge 44 is arranged axially as in FIG. 2, that is, the hinge 44 is a coupling running vertically along the axis of rotation, the apertures 30 and 32 would be located just to the interior of the axis rotation. This arrangement of apertures 30 and 32 vis-a-vis hinges 40 and 44 allows the flexible cable 16 to flex minimally during the opening and closing of the door 4. It may also be appreciated that the present invention may be practised by locating the apertures 30 and 32 exterior to the axis of rotation. However, this is not aesthetically desirable because it increases the visibility of the unsightly cable 16, and causes additional flexing of the cable 16 during the opening and closing of the door 4. Flexure should be minimized because, as in all mechanical devices, flexure or bending causes fatigue, which could lead, over time, to the breakdown or the printed circuit cable 16. To allow space for the flexure to take place, cavities 20 and 22 are provided.

Disposed within the cable 16 are printed conductors 24, the number of which depend upon the designer's choice. At a minimum there should be three, which correspond to a power input to the controller 14 and switches 6, a signal input and a signal output. The component from which or to which a signal is sent may conventionally be identified by an address prefix or by a multiplexing arrangement. However, it is equally possible to have as many conductors 24 as there are devices to be controlled.

As the conductors 24 are printed, they lie extremely flat and are ordered within the cable 16 into a plane such they they pose little resistance to bending in a direction normal to the plane. Thus there is a minimal interference to the opening and closing of the door 4 as well as minimal fatigue.

An alternative embodiment of the present invention may use a fiber optics cable 50 to transmit signals to and from the controller 14. Fiber optics cables are well adapted to be used in the present invention because they are composed of a plastic material and are, therefore, flexible.

The fiber optics cable 50 is mounted in the same manner as the flexible printed circuit cable 16. Mounted in the door 4, the cable runs out an aperture 54 in the door 4 located at or slightly interior to the axis of rotation of the hinge 52. From there, the fiber optics cable 50 crosses the space between the door 4 and housing member 10 to enter a second aperture 56 mounted in the housing member 10. As in FIG. 2, cavities 20 and 22 are located in the door 4 and housing member 10 to allow the fiber optics cable 50 room to flex.

This completes a description of the preferred embodiment and one alternative thereto. Various modifications may be made to the specifications above-enumerated without departing from the scope of the present invention, in which

I claim:

1. In a microwave oven having a housing member, electrically controllable components mounted therein, a cooking cavity mounted interior to said housing member, and a door for covering said cavity having axial mounting means for axially mounting said door on said housing member, the improvement comprising:

manually operable controls mounted on said door for controlling said electrically controllable components; and connecting means for operably connecting said controls with said components.

2. The invention of claim 1, wherein said connecting means includes an electronic controller mounted on said door, electrically responsive to said manually operable controls and operably connected to said components, for converting manual input from said controls into signals for operating said components.

3. The invention of claim 1 or claim 2, wherein said connecting means includes flexible means for operable connection across the space separating said door and said housing member substantially about the axis of said axial mounting means.

4. The invention of claim 3 wherein said flexible means includes a flexible electrically conductive cable having two ends, one end mounted on said door and the other end mounted on said housing member.

5. The invention of claim 4 wherein said flexible electrically conductive cable comprises printed flexible circuits.

6. The invention of claim 3 wherein said flexible means includes a flexible fiber optics cable having two ends, one end mounted on said door and the other end mounted on said housing member.

7. In a microwave oven having a housing member, electrically controllable components mounted therein, a cooking cavity mounted interior to said housing member, and a door for covering said cavity having axial mounting means for axially mounting said door on said housing member, the improvement comprising:

manually operable controls mounted on said door for controlling said electrically controllable components;

an electronic controller mounted on said door and electrically responsive to said manually operable controls for converting manual input from said controls into signals for controlling said electrically controllable components; and flexible means for operably connecting said controller with said electrically controllable components across the space separating said door and said housing member substantially about the axis of said axial mounting means.

* * * * *